US010003876B2

(12) United States Patent
Messingher

(10) Patent No.: US 10,003,876 B2
(45) Date of Patent: Jun. 19, 2018

(54) PLANAR MAGNETIC HEADPHONES

(71) Applicant: Sony Interactive Entertainment America LLC., San Mateo, CA (US)

(72) Inventor: Shai Messingher, San Mateo, CA (US)

(73) Assignee: SONY INTERACTIVE ENTERTAINMENT AMERICA LLC, San Mateo, CA (US)

( * ) Notice: Subject to any disclaimer, the term of this patent is extended or adjusted under 35 U.S.C. 154(b) by 16 days.

(21) Appl. No.: 15/243,387

(22) Filed: Aug. 22, 2016

(65) Prior Publication Data

US 2018/0020276 A1 Jan. 18, 2018

Related U.S. Application Data

(60) Provisional application No. 62/361,127, filed on Jul. 12, 2016.

(51) Int. Cl.

| | |
|---|---|
| ***H04R 7/04*** | (2006.01) |
| ***H04R 1/10*** | (2006.01) |
| ***H04R 7/18*** | (2006.01) |

(52) U.S. Cl.

CPC ..... *H04R 1/1008* (2013.01); *H04R 1/1066* (2013.01); *H04R 1/1075* (2013.01); *H04R 1/1083* (2013.01); *H04R 7/04* (2013.01); *H04R 7/18* (2013.01)

(58) Field of Classification Search

CPC ..... H04R 7/04

See application file for complete search history.

(56) References Cited

U.S. PATENT DOCUMENTS

| | | | | |
|---|---|---|---|---|
| 7,853,034 | B1 * | 12/2010 | Gresko | H04R 1/1058 381/370 |
| 2004/0182642 | A1 | 9/2004 | Hutt et al. | |
| 2015/0110339 | A1 | 4/2015 | Colich | |
| 2015/0326974 | A1 * | 11/2015 | Skubinski, III | H04R 7/04 381/309 |

* cited by examiner

*Primary Examiner* — Matthew Eason
*Assistant Examiner* — Phan Le
(74) *Attorney, Agent, or Firm* — John L. Rogitz

(57) ABSTRACT

Planar magnetic headphones include a single layer of parallel elongated magnets spaced from each other and supported on a magnet holder matrix. The holder matrix can be plastic or it can be a metallic permeability plate, with the magnets being on the inside (toward the ear) of the plate. Inboard of the magnets is a plastic dampening matrix that supports a first continuous disk-shaped dampening membrane. A serpentine circuit trace is established on a thin diaphragm that is outboard of the magnets to excite the magnets and move the diaphragm to produce sound according to the current in the trace. Still further outboard of the circuit race and positioned against a hard plastic outer cover is a second continuous disk-shaped dampening membrane. A circular pattern of holes is formed through the outer cover.

18 Claims, 5 Drawing Sheets

PLANAR MAGNETIC HEADPHONES

FIELD

The application relates generally to planar magnetic headphones.

BACKGROUND

The use of audio headphones to provide virtual reality (VR) experiences particularly in computer gaming is increasing. As understood herein, as computer games grow more sophisticated, audio reproduction of ever greater fidelity and range but reasonable cost may be desirable.

SUMMARY

Accordingly, a headphone establishes good acoustic impedance in a planar magnetic headphone.

In one aspect, a planar magnetic headphone includes an outer plastic shell formed with plural through-holes. The outer plastic shell faces away from a wearer of the headphone when the headphone is worn. A dampening matrix supports a first continuous disk-shaped sound dampener and faces a wearer of the headphone when the headphone is worn. One and only one layer of elongated magnets that are co-parallel and co-planar to each other are disposed between the outer plastic shell and the first continuous disk-shaped sound dampener. A magnet holder matrix is flush against the layer of elongated magnets. The magnet holder matrix includes cross-elements establishing openings between adjacent cross-elements. A sound diaphragm with a serpentine circuit is disposed between the magnets and the dampening matrix such that electricity passing through the circuit cooperates with a magnetic field produced by the magnets to move the diaphragm to produce sound. At least a second continuous disk-shaped sound dampener is disposed between the magnet holder and the outer shell.

In some embodiments, the magnet holder matrix is made of plastic. In other embodiments, the magnet holder matrix is made of metal to establish a magnetic permeability plate.

The holes in the outer plastic shell can be arranged in a ring.

If desired, no adhesive may be used to hold the magnets onto the magnet holder matrix. However, in other embodiments adhesive can hold the magnets onto the magnet holder matrix.

In some implementations the magnets face the outer shell and the magnet holder matrix faces the first continuous disk-shaped sound dampener. In other implementations the magnets face the first continuous disk-shaped sound dampener and the magnet holder matrix faces the outer shell.

In examples, a third continuous disk-shaped sound dampener may be disposed between the second continuous disk-shaped sound dampener and the diaphragm.

In non-limiting examples, the serpentine circuit defines plural elongated segments parallel to each other and separated from each other by a respective connector segment, and the long axis of each elongated magnet is parallel to the long axis of each elongated segment of the serpentine circuit. In some non-limiting examples, the serpentine circuit defines plural elongated segments parallel to each other and separated from each other by a respective connector segment, and the serpentine circuit has no more than four elongated segments.

In non-limiting examples, five and only five elongated magnets are used. In other non-limiting examples, seven and only seven elongated magnets are used.

The first and second continuous disk-shaped sound dampeners may be made of mesh.

In non-limiting examples, the serpentine circuit defines plural elongated segments parallel to each other and separated from each other by a respective connector segment. Each elongated segment may include plural traces parallel to each other and spaced from each other by a distance, with each trace having a width in the range 0.43 mm to 0.48 mm inclusive, and with the distance being in the range between 0.37 mm and 0.45 mm inclusive.

In another aspect, an apparatus includes a planar magnetic drive assembly including plural magnets closely juxtaposed with a drive circuit on a diaphragm. An outer plastic shell formed with plural through-holes covers the drive assembly. A first continuous disk-shaped sound dampener faces a wearer of the headphone when the headphone is worn, with the planar magnetic drive assembly being disposed between the outer plastic shell and the first continuous disk-shaped driver. Also, at least a second continuous disk-shaped sound dampener is disposed between the planar magnetic drive assembly and the outer shell.

In another aspect, an assembly includes a planar magnetic drive assembly including plural magnets closely juxtaposed with a drive circuit on a diaphragm. An outer plastic shell is formed with plural through-holes and covers the drive assembly, while plural sound dampeners are disposed in the assembly parallel to the planar magnetic drive assembly.

The details of the present application, both as to its structure and operation, can best be understood in reference to the accompanying drawings, in which like reference numerals refer to like parts, and in which:

DETAILED DESCRIPTION

Figure 1:
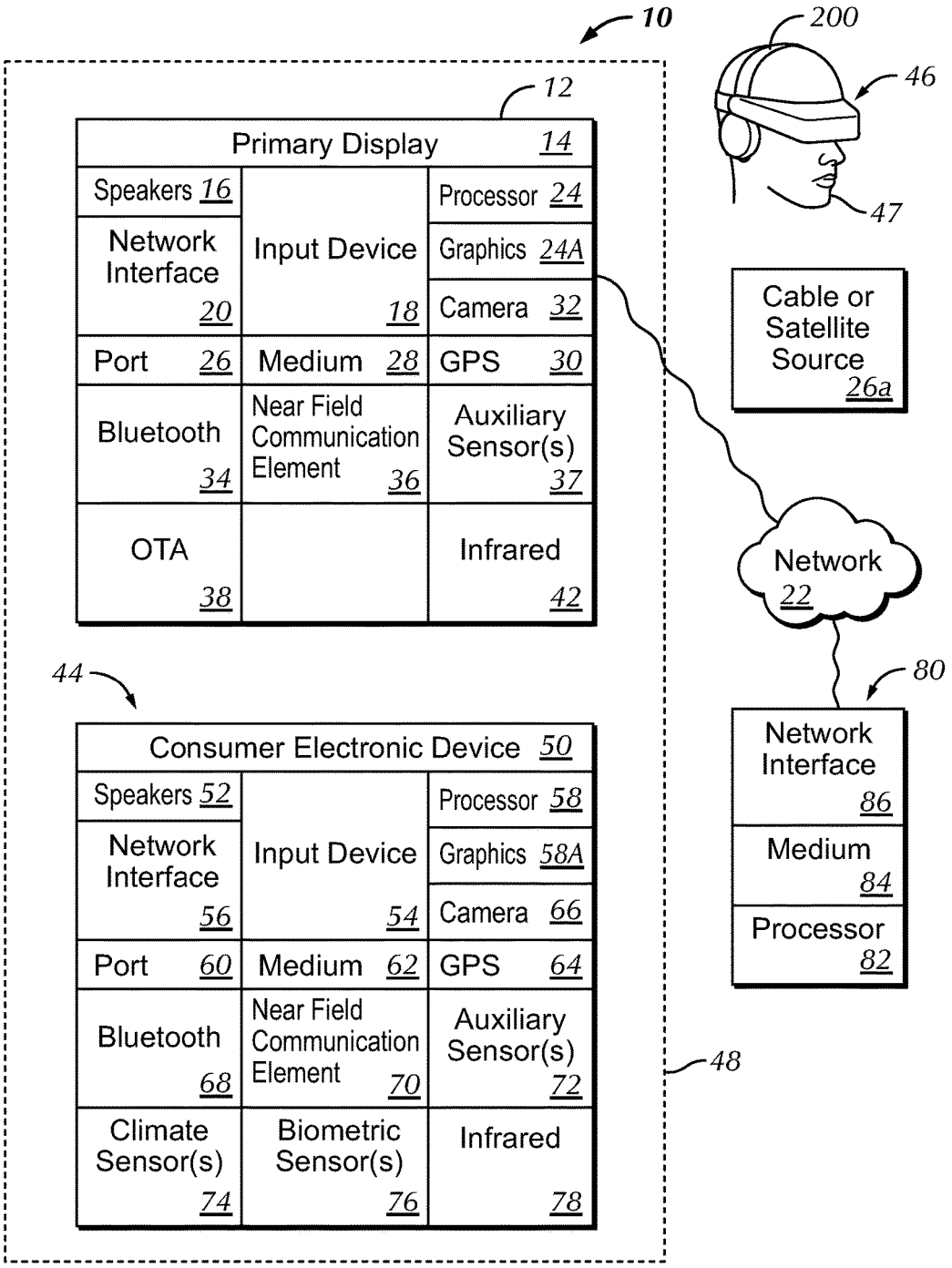
FIG. 1 is a block diagram of an example system including an example in accordance with present principles.

This disclosure relates generally to computer ecosystems including aspects of consumer electronics (CE) device networks such as but not limited to computer game networks. A system herein may include server and client components, one or more of which may be associated with a headphone such as disclosed herein and which may be connected over a network such that data may be exchanged between the client and server components. The client components may include one or more computing devices including game consoles such as Sony PlayStation® or a game console made by Microsoft or Nintendo or other manufacturer, virtual reality (VR) headsets, augmented reality (AR) headsets, portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, Linux operating systems, operating systems from Microsoft, or a Unix operating system, or operating systems produced by Apple Computer or Google. These operating environments may be used to execute one or more browsing programs, such as a browser made by Microsoft or Google or Mozilla or other browser program that can access websites hosted by the Internet servers discussed below. Also, an operating environment according to present principles may be used to execute one or more computer game programs.

Servers and/or gateways may include one or more processors executing instructions that configure the servers to receive and transmit data over a network such as the Internet. Or, a client and server can be connected over a local intranet or a virtual private network. A server or controller may be instantiated by a game console such as a Sony PlayStation®, a personal computer, etc.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

A processor may be any conventional general purpose single- or multi-chip processor that can execute logic by means of various lines such as address lines, data lines, and control lines and registers and shift registers.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is a consumer electronics (CE) device such as an audio video device (AVD) 12 such as but not limited to an Internet-enabled TV with a TV tuner (equivalently, set top box controlling a TV). However, the AVD 12 alternatively may be an appliance or household item, e.g. computerized Internet enabled refrigerator, washer, or dryer. The AVD 12 alternatively may also be a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc. Regardless, it is to be understood that the AVD 12 is configured to undertake present principles (e.g. communicate with other CE devices to undertake present principles, execute the logic described herein, and perform any other functions and/or operations described herein).

Accordingly, to undertake such principles the AVD 12 can be established by some or all of the components shown in FIG. 1. For example, the AVD 12 can include one or more displays 14 that may be implemented by a high definition or ultra-high definition "4K" or higher flat screen and that may be touch-enabled for receiving user input signals via touches on the display. The AVD 12 may include one or more speakers 16 for outputting audio in accordance with present principles, and at least one additional input device 18 such as e.g. an audio receiver/microphone for e.g. entering audible commands to the AVD 12 to control the AVD 12. The example AVD 12 may also include one or more network interfaces 20 for communication over at least one network 22 such as the Internet, an WAN, an LAN, etc. under control of one or more processors 24. A graphics processor 24A may also be included. Thus, the interface 20 may be, without limitation, a Wi-Fi transceiver, which is an example of a wireless computer network interface, such as but not limited to a mesh network transceiver. It is to be understood that the processor 24 controls the AVD 12 to undertake present principles, including the other elements of the AVD 12 described herein such as e.g. controlling the display 14 to present images thereon and receiving input therefrom. Furthermore, note the network interface 20 may be, e.g., a wired or wireless modem or router, or other appropriate interface such as, e.g., a wireless telephony transceiver, or Wi-Fi transceiver as mentioned above, etc.

In addition to the foregoing, the AVD 12 may also include one or more input ports 26 such as, e.g., a high definition multimedia interface (HDMI) port or a USB port to physically connect (e.g. using a wired connection) to another CE device and/or a headphone port to connect headphones to the AVD 12 for presentation of audio from the AVD 12 to a user through the headphones. For example, the input port 26 may be connected via wire or wirelessly to a cable or satellite source 26*a* of audio video content. Thus, the source 26*a* may be, e.g., a separate or integrated set top box, or a satellite receiver. Or, the source 26*a* may be a game console or disk player containing content that might be regarded by a user as a favorite for channel assignation purposes described further below. The source 26*a* when implemented as a game console may include some or all of the components described below in relation to the CE device 44.

The AVD 12 may further include one or more computer memories 28 such as disk-based or solid state storage that are not transitory signals, in some cases embodied in the chassis of the AVD as standalone devices or as a personal video recording device (PVR) or video disk player either internal or external to the chassis of the AVD for playing back AV programs or as removable memory media. Also in some embodiments, the AVD 12 can include a position or location receiver such as but not limited to a cellphone receiver, GPS receiver and/or altimeter 30 that is configured to e.g. receive geographic position information from at least one satellite or cellphone tower and provide the information to the processor 24 and/or determine an altitude at which the AVD 12 is disposed in conjunction with the processor 24. However, it is to be understood that that another suitable position receiver other than a cellphone receiver, GPS receiver and/or altimeter may be used in accordance with present principles to e.g. determine the location of the AVD 12 in e.g. all three dimensions.

Continuing the description of the AVD 12, in some embodiments the AVD 12 may include one or more cameras 32 that may be, e.g., a thermal imaging camera, a digital camera such as a webcam, and/or a camera integrated into the AVD 12 and controllable by the processor 24 to gather pictures/images and/or video in accordance with present principles. Also included on the AVD 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the AVD 12 may include one or more auxiliary sensors 37 (e.g., a motion sensor such as an accelerometer, gyroscope, cyclometer, or a magnetic sensor, an infrared (IR) sensor, an optical sensor, a speed and/or cadence sensor, a gesture sensor (e.g. for sensing gesture command), etc.) providing input to the processor 24. The AVD 12 may include an over-the-air TV broadcast port 38 for receiving OTA TV broadcasts providing input to the processor 24. In addition to the foregoing, it is noted that the AVD 12 may also include an infrared (IR) transmitter and/or IR receiver and/or IR transceiver 42 such as an IR data association (IRDA) device. A battery (not shown) may be provided for powering the AVD 12, as may be a kinetic energy harvester that may turn kinetic energy into power to charge the battery and/or power the AVD 12.

Still referring to FIG. 1, in addition to the AVD 12, the system 10 may include one or more other CE device types. In one example, a first CE device 44 may be used to send computer game audio and video to the AVD 12 via commands sent directly to the AVD 12 and/or through the below-described server while a second CE device 46 may include similar components as the first CE device 44. In the example shown, the second CE device 46 may be configured as a headphone 200 worn by a player 47 as shown. In the example shown, only two CE devices 44, 46 are shown, it being understood that fewer or greater devices may be used. For example, principles below discuss multiple players 47 with respective headphones communicating with each other during play of a computer game sourced by a game console to one or more AVD 12. The headphones may be combined into a VR head mounted display (HMD).

In the example shown, to illustrate present principles all three devices 12, 44, 46 are assumed to be members of an entertainment network in, e.g., a home, or at least to be present in proximity to each other in a location such as a house. However, present principles are not limited to a particular location, illustrated by dashed lines 48, unless explicitly claimed otherwise.

The example non-limiting first CE device 44 may be established by any one of the above-mentioned devices, for example, a portable wireless laptop computer or notebook computer or gaming computer (also referred to as "console"), and accordingly may have one or more of the components described below. The first CE device 44 may be a remote control (RC) for, e.g., issuing AV play and pause commands to the AVD 12, or it may be a more sophisticated device such as a tablet computer, a game controller communicating via wired or wireless link with the AVD 12, a personal computer, a VR headset, a wireless telephone, etc.

Accordingly, the first CE device 44 may include one or more displays 50 that may be touch-enabled for receiving user input signals via touches on the display. The first CE device 44 may include one or more speakers 52 for outputting audio in accordance with present principles, and at least one additional input device 54 such as e.g. an audio receiver/microphone for e.g. entering audible commands to the first CE device 44 to control the device 44. The example first CE device 44 may also include one or more network interfaces 56 for communication over the network 22 under control of one or more CE device processors 58. A graphics processor 58A may also be included. Thus, the interface 56 may be, without limitation, a Wi-Fi transceiver, which is an example of a wireless computer network interface, including mesh network interfaces. It is to be understood that the processor 58 controls the first CE device 44 to undertake present principles, including the other elements of the first CE device 44 described herein such as e.g. controlling the display 50 to present images thereon and receiving input therefrom. Furthermore, note the network interface 56 may be, e.g., a wired or wireless modem or router, or other appropriate interface such as, e.g., a wireless telephony transceiver, or Wi-Fi transceiver as mentioned above, etc.

In addition to the foregoing, the first CE device 44 may also include one or more input ports 60 such as, e.g., a HDMI port or a USB port to physically connect (e.g. using a wired connection) to another CE device and/or a headphone port to connect headphones to the first CE device 44 for presentation of audio from the first CE device 44 to a user through the headphones. The first CE device 44 may further include one or more tangible computer readable storage medium 62 such as disk-based or solid state storage. Also in some embodiments, the first CE device 44 can include a position or location receiver such as but not limited to a cellphone and/or GPS receiver and/or altimeter 64 that is configured to e.g. receive geographic position information from at least one satellite and/or cell tower, using triangulation, and provide the information to the CE device processor 58 and/or determine an altitude at which the first CE device 44 is disposed in conjunction with the CE device processor 58. However, it is to be understood that that another suitable position receiver other than a cellphone and/or GPS receiver and/or altimeter may be used in accordance with present principles to e.g. determine the location of the first CE device 44 in e.g. all three dimensions.

Continuing the description of the first CE device 44, in some embodiments the first CE device 44 may include one or more cameras 66 that may be, e.g., a thermal imaging camera, a digital camera such as a webcam, and/or a camera integrated into the first CE device 44 and controllable by the CE device processor 58 to gather pictures/images and/or video in accordance with present principles. Also included on the first CE device 44 may be a Bluetooth transceiver 68 and other Near Field Communication (NFC) element 70 for communication with other devices using Bluetooth and/or NFC technology, respectively. An example NFC element can be a radio frequency identification (RFID) element.

Further still, the first CE device 44 may include one or more auxiliary sensors 72 (e.g., a motion sensor such as an accelerometer, gyroscope, cyclometer, or a magnetic sensor, an infrared (IR) sensor, an optical sensor, a speed and/or cadence sensor, a gesture sensor (e.g. for sensing gesture command), a pressure sensor, etc.), providing input to the CE device processor 58. The first CE device 44 may include still other sensors such as e.g. one or more climate sensors 74 (e.g. barometers, humidity sensors, wind sensors, light sensors, temperature sensors, etc.) and/or one or more biometric sensors 76 providing input to the CE device processor 58. In addition to the foregoing, it is noted that in some embodiments the first CE device 44 may also include an infrared (IR) transmitter and/or IR receiver and/or IR transceiver 78 such as an IR data association (IRDA) device. A battery (not shown) may be provided for powering the first CE device 44. The CE device 44 may communicate with the AVD 12 through any of the above-described communication modes and related components.

The second CE device 46 may include some or all of the components shown for the CE device 44. Either one or both CE devices may be powered by one or more batteries.

Now in reference to the afore-mentioned at least one server 80, it includes at least one server processor 82, at least one tangible computer readable storage medium 84 such as disk-based or solid state storage, and at least one network interface 86 that, under control of the server processor 82, allows for communication with the other devices of FIG. 1 over the network 22, and indeed may facilitate communication between servers and client devices in accordance with present principles. Note that the network interface 86 may be, e.g., a wired or wireless modem or router, Wi-Fi transceiver, or other appropriate interface such as, e.g., a wireless telephony transceiver.

Accordingly, in some embodiments the server 80 may be an Internet server or an entire server "farm", and may include and perform "cloud" functions such that the devices of the system 10 may access a "cloud" environment via the server 80 in example embodiments for, e.g., network gaming applications. Or, the server 80 may be implemented by one or more game consoles or other computers in the same room as the other devices shown in FIG. 1 or nearby.

Figure 2:
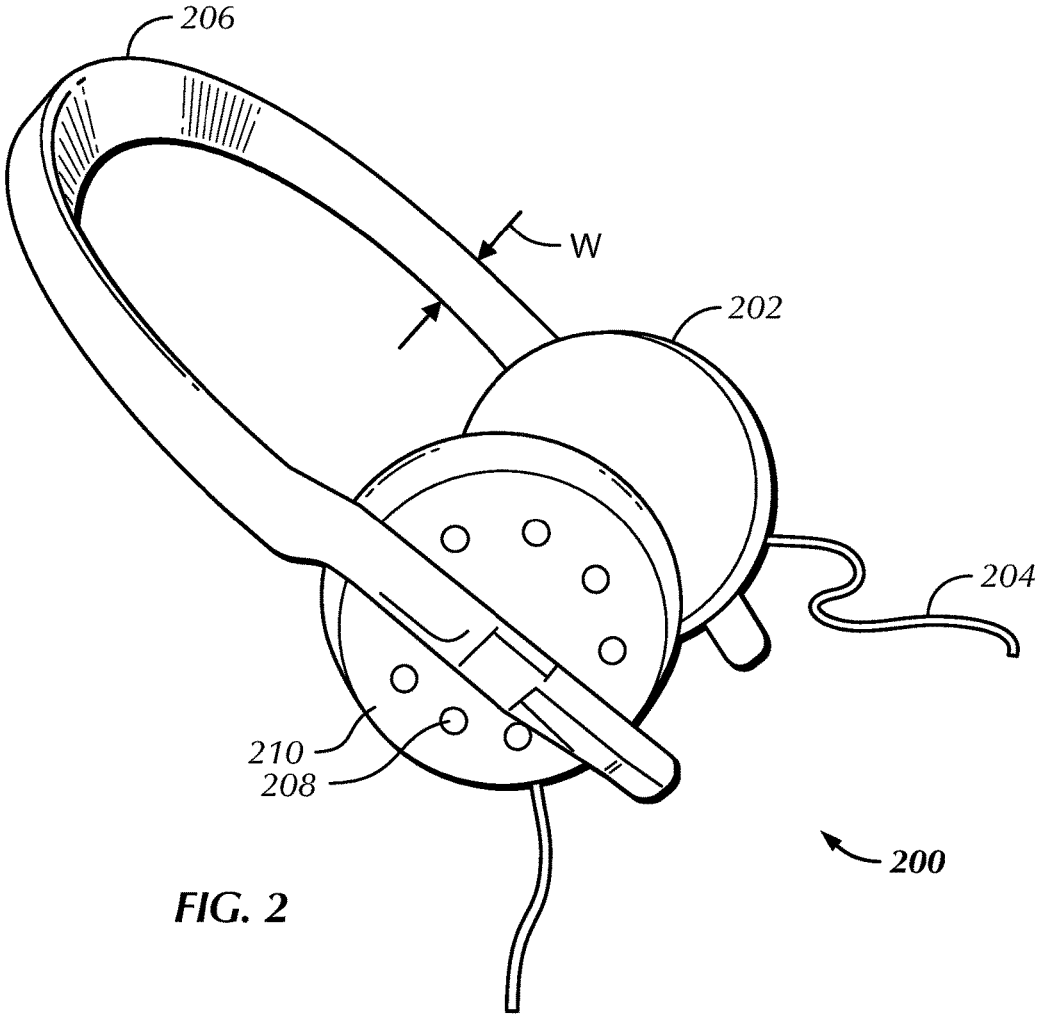
FIG. 2 is a perspective view of a headset that can employ the planar magnetics audio reproduction divulged herein.

FIG. 2 shows a headphone 200 that may incorporate appropriate components of the second CE device 46 described above, as amplified below. As shown, the headphone 200 includes left and right ear pieces 202 that are identical to each other in configuration and operation, the details of one of which are disclosed further below in reference to FIG. 3. One or more electrical leads 204 may connect relevant components in the earpieces to a source of audio.

The earpieces 202 are connected together by a connector 206, which may be a simple cord or, as shown, a strap or semi-rigid arcuate-shaped arm. In the example shown, the width "W" of the arm is relatively narrow, so as not to block through-holes 208 formed in the outer plastic shell 210 of an earpiece 202. In the example shown, the through-holes 208 are arranged in a circular or ring-shaped pattern.

Figure 3:
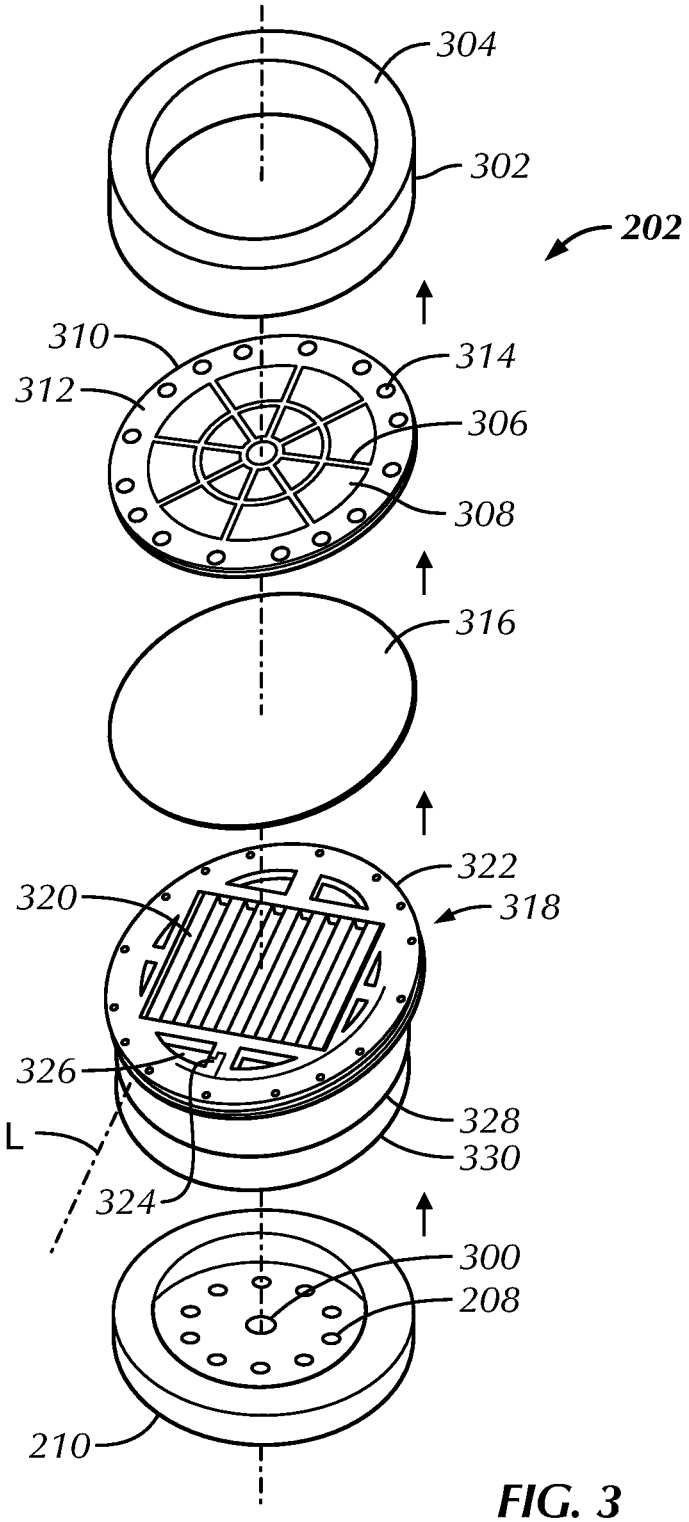
FIG. 3 is an exploded view of a single earpiece of the headset, omitting the circuit trace from the diaphragm.

Leading to FIG. 3, the outer plastic shell 210, in addition to the through-holes 208, may be formed with a central opening 300 for receiving a mounting connector of the arm 206 in FIG. 2 and/or for receiving an electrical lead 204 therethrough. As shown, like the rest of the components in FIG. 3, the outer plastic shell 210 has a circular shape.

The outer plastic shell 210 thus is the outermost portion the earpiece 202 relative to a person's head when the person is wearing the headphones, and thus faces away from the wearer. To provide a comfortable fit for a wearer, the inner-most portion of the earpiece 202 may be a padded hollow cylindrical-shaped ear pad 302 that faces the wearer. The ear pad 302 may be foam encased in an outer plastic sleeve. The remaining components of the earpiece 202 are thus disposed between the inner surface 304 of the ear pad 302 and the outer shell 210.

In order from inner to outer (i.e., from the ear pad 302 to the outer plastic shell 210), the ear piece 202 can include a dampening matrix 306 that supports a first continuous disk-shaped sound dampener 308 that faces a wearer of the headphone when the headphone is worn. Note that the example dampening matrix 306 includes plural struts that extend outward from the center of the matrix 306 to the outer periphery 310 of the matrix, which may be reinforced by a mounting ring 312 as shown. The dampener 308, which is disk-shaped and continuous such that it completely encloses the apertures between the struts of the matrix, can be glued to the mounting ring 312, which in turn may be formed with mount holes 314. Like the other sound dampeners described below, the first sound dampener 308 may be made of mesh such as 40D spandex, 140 g/yd.

Outboard of the dampening matrix 306 is a sound diaphragm 316 shaped as a continuous disk and having a circuit trace on it (not shown in FIG. 3). Example circuit traces are described further below. When current from a sound source (via the lead 204 in FIG. 2, for instance) is passed through the circuit trace on the diaphragm, the electricity passing through the circuit trace cooperates with a magnetic field produced by the below-described magnets to move the diaphragm 316 to produce sound. In the example shown, the diaphragm 316 is made of polyurethane composite material and/or polyethylene terephthalate (PET). The resonant frequency of the diaphragm 316 can be between 80 Hz to 220 Hz, inclusive.

Outboard of the diaphragm 316 is a planar magnet drive assembly 318. In the example shown, the planar magnet drive assembly 318 includes plural elongated magnets 320 arranged co-planar and co-parallel to each other on a magnet plate. In one example, at least five magnets 320 are used. In an example, five and only five magnets are used. In the example of FIG. 3, seven and only seven magnets are used. Other numbers of magnets may be used. Furthermore, in the example of FIG. 3, one and only one layer of elongated magnets 320 are used.

In some examples, each magnet 320 may have a length of 50 mm, a width of 6.4 mm, and a depth of 3 mm. In another example, each magnet 320 may have a length of 50 mm, a width of 5 mm, and a depth of 3 mm, and five magnets may be used in such dimensions. In another example, each magnet 320 may have a length of 50 mm, a width of 4.5 mm, and a depth of 3 mm, and seven magnets may be used in such dimensions. In example implementations, each magnet 320 may be made of N48 (meaning a maximum energy product in Mega-Gauss Oersteds (MGOe) of 48) Neodymium-Iron-Boron (NdFeB).

A magnet holder matrix 322 is positioned flush against the layer of elongated magnets 320 (e.g., the magnet plate may lay flush on the matrix 322). As shown, in example embodiments the magnet holder matrix 322 is formed as disk with straight rigid cross-elements 324 establishing openings 326 between adjacent cross-elements. Some cross-elements are oriented along non-diameter chords of the round magnet holder matrix while other cross-elements may be oriented along radials of the matrix.

In some examples, the magnet holder matrix 322 is made of plastic. In other examples, the magnet holder matrix 322 is made of metal to establish a magnetic permeability plate. Adhesive may be used to bond the magnets 320 to the matrix 322 but in other embodiments, particularly when the matrix is metal and, thus, a strong magnetic coupling holds the magnets onto the matrix, no adhesive may be used to hold the magnets onto the magnet holder matrix.

In the example shown, the magnets 320 face the first continuous disk-shaped sound dampener 308 and the magnet holder matrix 322 faces the outer shell 210. In other examples, the magnets 320 may face the outer shell 210 and the magnet holder matrix 322 may face the first continuous disk-shaped sound dampener 308. In less preferred examples, the planar magnet drive assembly 318 may be disposed between the diaphragm 316 and the first continuous disk-shaped sound dampener 308.

Returning to the specific example shown in FIG. 3, a second continuous disk-shaped sound dampener 328 may be outboard of the magnet holder matrix 322 and may be bonded along its outer periphery to the magnet holder matrix 322. Still further, a third continuous disk-shaped sound dampener 330 may be closely spaced from or even flush against the second continuous disk-shaped sound dampener 328 and the outer shell 210, and may be bonded along its outer periphery to the outer shell 210.

Figure 4:
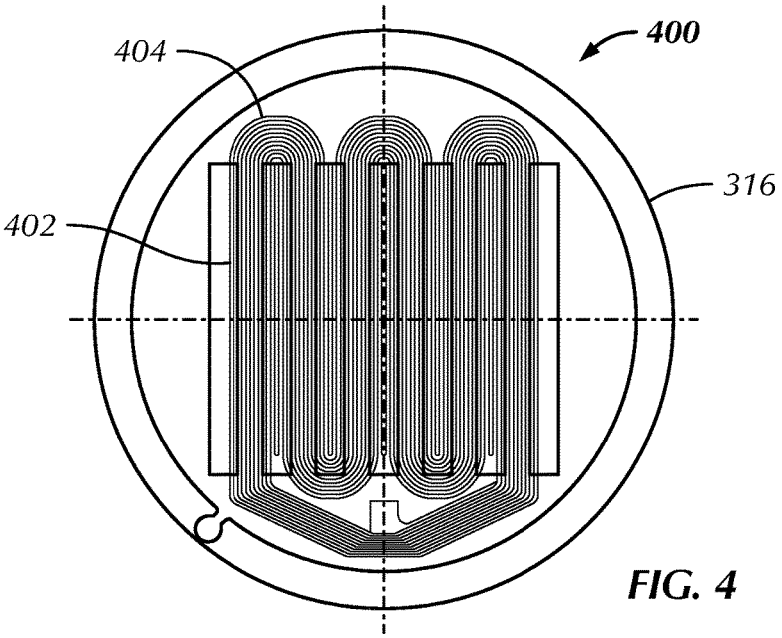
FIG. 4 is a plan view of a first embodiment of a serpentine circuit on a diaphragm.
Figure 5:
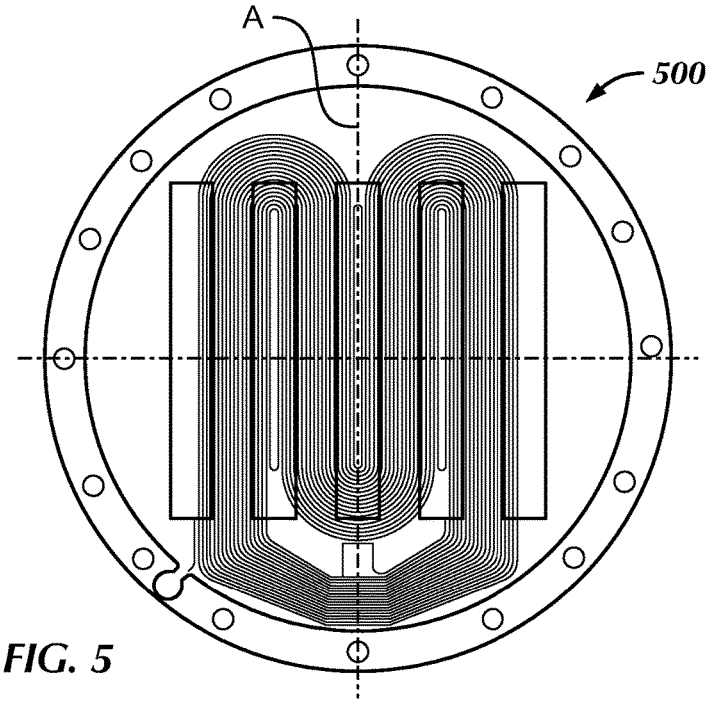
FIG. 5 is a plan view of a second embodiment of a serpentine circuit on a diaphragm.

FIGS. 4 and 5 illustrate two example circuits that may be disposed on the diaphragm 316 of FIG. 3. FIG. 4 shows a serpentine circuit 400 defining plural elongated segments 402 that are parallel to each other and that are separated from each other by a respective connector segment 404, in the embodiment shown, a semi-circular segment. In FIG. 4, six elongated segments 402 are used. In the circuit 500 of FIG. 5, only four elongated segments are used as shown. Note that in preferred embodiments and the long axis "L" (FIG. 3) of each elongated magnet 320 is parallel to the long axis "A" of each elongated segment of the serpentine circuit.

Figure 6:
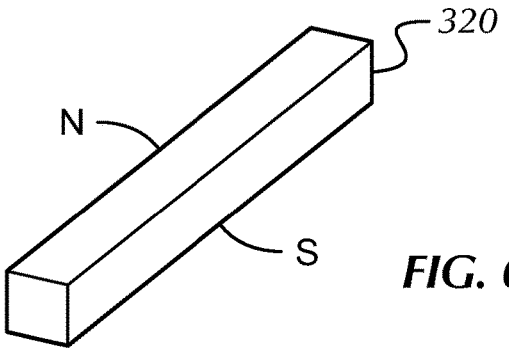
FIG. 6 is a perspective view of one of the magnets, illustrating schematically its magnetization.

FIG. 6 shows that the magnets 320 can be magnetized in an orientation from their surface that faces the magnet holder matrix 322 to the opposite surface. Thus, in FIG. 6 the surface of the magnet 320 that faces the magnet holder matrix 322 may be the south pole as indicated while the opposite surface may be the north pole.

Figure 7:
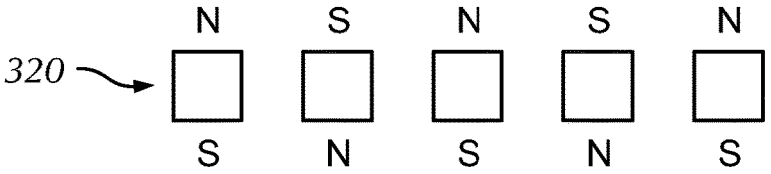
FIGS. 7 and 8 are schematic end views of the magnets, illustrating two arrangements of polarity.
Figure 8:
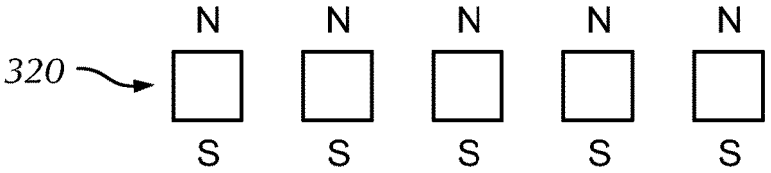

FIG. 7 shows that the magnets 320 may be oriented with their magnetic poles alternating with each other, such that the south pole of the first magnet in the row of parallel magnets faces the magnet holder matrix, the north pole of the second magnet faces the matrix, the south pole of the third magnet (between which and the first magnet the second magnet is disposed) face the matrix, and so on. FIG. 8 shows a less preferred approach in which the south pole of all magnets (or if desired the north pole of all magnets) faces the matrix. In other embodiments, different combinations of magnetic orientation may be used.

Figure 9:
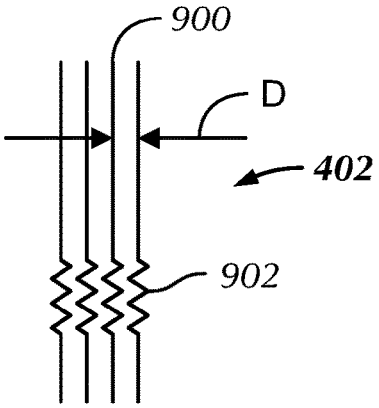
FIG. 9 is a schematic view of a portion of an elongated segment of a serpentine circuit.

FIG. 9 shows a portion of an elongated segment 402 of a circuit, in which the circuit is shown to include multiple co-parallel electrically conductive traces equidistantly spaced from each other. While the traces 900 (and hence the elongated segment 402) are generally straight, they may contain parallel sawtooth-shaped segments 902 as shown. Each trace 900 may have a width in the range 0.43 mm to 0.48 mm inclusive, and may have a width of 0.47 mm, while the distance "D" between adjacent traces 900 may be in the range between 0.37 mm and 0.45 mm inclusive and may be 0.43 mm.

It will be appreciated that whilst present principals have been described with reference to some example embodiments, these are not intended to be limiting, and that various alternative arrangements may be used to implement the subject matter claimed herein.

What is claimed is:

1. Planar magnetic headphone, comprising:

an outer plastic shell, the outer plastic shell facing away from a wearer of the headphone when the headphone is worn;

a dampening matrix that supports a first continuous disk-shaped sound dampener that faces a wearer of the headphone when the headphone is worn, the first continuous disk-shaped sound dampener being on the dampening matrix;

at least one layer of elongated magnet elements co-parallel and co-planar to each other and disposed between the outer plastic shell and the first continuous disk-shaped sound dampener;

a magnet holder matrix flush against the layer of elongated magnet elements, the magnet holder matrix comprising cross-elements establishing openings between adjacent cross-elements;

a sound diaphragm with a serpentine circuit disposed between the magnet elements and the dampening matrix that supports the first continuous disk-shaped sound dampener such that electricity passing through the circuit cooperates with a magnetic field produced by the magnet elements to move the diaphragm to produce sound; and at least a second continuous disk-shaped sound dampener disposed between the magnet holder and the outer shell.

2. The planar magnetic headphone of claim 1, wherein the magnet holder matrix is made of plastic.

3. The planar magnetic headphone of claim 1, wherein the magnet holder matrix is made of metal to establish a magnetic permeability plate.

4. The planar magnetic headphone of claim 1, comprising openings in the outer plastic shell arranged in a ring.

5. The planar magnetic headphone of claim 1, wherein no adhesive holds the magnet elements onto the magnet holder matrix.

6. The planar magnetic headphone of claim 1, comprising adhesive holding the magnet elements onto the magnet holder matrix.

7. The planar magnetic headphone of claim 1, wherein the magnet elements face the outer shell and the magnet holder matrix faces the first continuous disk-shaped sound dampener.

8. The planar magnetic headphone of claim 1, wherein the magnet elements face the first continuous disk-shaped sound dampener and the magnet holder matrix faces the outer shell.

9. The planar magnetic headphone of claim 1, comprising at least a third continuous disk-shaped sound dampener disposed between the second continuous disk-shaped sound dampener and the diaphragm.

10. The planar magnetic headphone of claim 1, wherein the serpentine circuit defines plural elongated segments parallel to each other and separated from each other by a respective connector segment, and the long axis of each elongated magnet element is parallel to the long axis of each elongated segment of the serpentine circuit.

11. The planar magnetic headphone of claim 1, wherein the serpentine circuit defines plural elongated segments parallel to each other and separated from each other by a respective connector segment, the serpentine circuit comprising no more than four elongated segments.

12. The planar magnetic headphone of claim 1, comprising five and only five elongated magnet elements.

13. The planar magnetic headphone of claim 1, comprising seven and only seven elongated magnet elements.

14. The planar magnetic headphone of claim 1, wherein the first and second continuous disk-shaped sound dampeners are made of mesh.

15. The planar magnetic headphone of claim 1, wherein the serpentine circuit defines plural elongated segments parallel to each other and separated from each other by a respective connector segment, each elongated segment comprising plural traces parallel to each other and spaced from each other by a distance, each trace having a width in the range 0.43 mm to 0.48 mm inclusive, the distance being in the range between 0.37 mm and 0.45 mm inclusive.

16. Apparatus, comprising:

a planar magnetic drive assembly including plural magnets closely juxtaposed with a drive circuit on a diaphragm;

an outer plastic shell formed with plural through-holes;

a first continuous disk-shaped sound dampener that faces a wearer of the headphone when the headphone is worn, the planar magnetic drive assembly being disposed between the outer plastic shell and the first continuous disk-shaped sound dampener; and at least a second continuous disk-shaped sound dampener disposed between the planar magnetic drive assembly and the outer shell, wherein the drive circuit defines plural elongated segments parallel to each other and separated from each other by a respective connector segment, each elongated segment comprising plural traces parallel to each other and spaced from each other by a distance, each trace having a width in the range 0.43 mm to 0.48 mm inclusive, the distance being in the range between 0.37 mm and 0.45 mm inclusive.

17. The apparatus of claim 16, wherein the drive circuit comprises no more than four elongated segments each comprising respective plural traces, the plural magnets being arranged in one and only one layer.

18. The apparatus of claim 16, comprising seven and only seven elongated magnets.

* * * * *